US006758134B2

(12) United States Patent
Strebel

(10) Patent No.: US 6,758,134 B2
(45) Date of Patent: Jul. 6, 2004

(54) METHOD FOR REBUILDING A CALENDER

(75) Inventor: Richard Strebel, Appleton, WI (US)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 10/444,414

(22) Filed: May 23, 2003

(65) Prior Publication Data

US 2003/0192438 A1 Oct. 16, 2003

Related U.S. Application Data

(62) Division of application No. 09/618,213, filed on Jul. 14, 2000, now Pat. No. 6,612,228.

(51) Int. Cl.[7] ..... B30B 13/00; B23P 6/00

(52) U.S. Cl. ..... 100/35; 100/168; 100/155 R; 29/897.1; 29/401.1; 29/402.03

(58) Field of Search ..... 100/35, 162 R, 100/163 R, 163 A, 164, 168, 173, 175, 155 R, 159, 160, 161; 29/897.1, 897, 401.1, 402.01, 402.03, 402.04, 402.08, 402.11

(56) References Cited

U.S. PATENT DOCUMENTS 1,989,834 A * 2/1935 Watson ..... 29/897.1
2,985,100 A * 5/1961 Hornbostel ..... 100/163 A
3,016,819 A * 1/1962 Kupka ..... 100/163 A
3,154,008 A * 10/1964 Hurter ..... 100/162 R
4,311,091 A * 1/1982 Pav et al. ..... 100/161
4,890,551 A * 1/1990 Dahl et al. ..... 100/163 A
4,901,637 A * 2/1990 Hagel et al. ..... 100/162 R
4,924,772 A * 5/1990 Schlunke et al. ..... 100/163 R
5,038,678 A * 8/1991 Honkala et al. ..... 100/163 R
5,231,924 A * 8/1993 Schneid ..... 100/163 A
5,351,400 A * 10/1994 Samuel ..... 29/401.1
5,438,920 A * 8/1995 Koivukunnas et al. .. 100/163 A
5,443,000 A * 8/1995 Wenzel ..... 100/163 A

* cited by examiner

*Primary Examiner*—John Sipos
*Assistant Examiner*—Louis Huynh
(74) *Attorney, Agent, or Firm*—Steinberg & Raskin, P.C.

(57) ABSTRACT

A calender having a supporting frame and a set of rolls attached to vertical portions of the supporting frame so as to form a stack of rolls in which adjacent rolls placed one above another form calendering nips therebetween. The stack including a top roll, a bottom roll and a plurality of intermediate rolls between the top roll and the bottom roll. The intermediate rolls are attached revolvingly to arms pivoted on auxiliary frames attached to vertical portions of the supporting frame. A method of rebuilding a calender in which auxiliary frames are attached to the vertical portions of the existing calender frame and thereafter pivotal arms for the intermediate rolls are mounted on the auxiliary frames.

4 Claims, 2 Drawing Sheets

METHOD FOR REBUILDING A CALENDER

CROSS REFERENCE TO RELATED APPLICATION

The present application is a divisional application of U.S. patent application Ser. No. 09/618,213 filed on Jul. 14, 2000 now U.S. Pat. No. 6,612,228.

FIELD OF THE INVENTION

The present invention relates to a calender having a supporting frame and a set of rolls attached to vertical portions of the supporting frame so as to form a stack of rolls in which adjacent rolls are arranged one above the other forming calendering nips therebetween, the stack including a top roll, a bottom roll and a plurality of intermediate rolls arranged between the top roll and the bottom roll. The invention also relates to a method of rebuilding a calender where the structure of an existing calender is employed in the constructing a modernized calender.

BACKGROUND OF THE INVENTION

The set of rolls in a calender conventionally comprises a plurality of rolls which are arranged one above the other as a stack of rolls. The rolls are placed one above another and adjacent rolls in the stack are in nip contact with one another, the nips defined between adjacent rolls being structured and arranged for calendering a paper or board web or equivalent run between the nips of the rolls. The rolls are journaled on bearing housings for permitting the rotation of rolls, which in turn are normally attached to slides fitted on vertical guides provided in the frame of the calender. The slides are suspended through spindle nuts on vertical lifting spindles provided in the frame of the calender. Thus, the rolls of the set of rolls are not rigidly fixed at their bearing housings to the frame of the calender, but, instead, the rolls can move in a vertical direction.

The mass of the bearing housings of the rolls and the auxiliary devices attached thereto, such as, fly rolls, are quite large, and as such, cause in conventional calenders the considerable drawback of distortions in the distribution of the linear loads of the nips. For this reason, calenders have started to incorporate relief devices which are supported on the slides of the rolls, on one hand, and on spindle nuts provided on the lifting spindles, on the other hand. In this manner, distortions caused by the weight of the bearing housings of the rolls and the auxiliary devices attached thereto in the linear load profiles between the rolls can be relieved by means of relief devices. One such arrangement is disclosed in U.S. Pat. No. 4,901,637, the entire disclosure of which is incorporated herein by reference.

The use of relief devices is previously known also from conventional machine calenders, in which attempts are made to eliminate, in particular, by means of hydraulic relief cylinders, the above-mentioned effect of concentrated loads arising from the bearing housings of the rolls and from auxiliary devices.

New supercalenders have begun to employ polymer rolls as soft rolls instead of fiber rolls, whereupon the total height variation of the set of rolls has remained considerably smaller than in conventional supercalenders that use fiber rolls. One reason for this reduced total height variation has been the fact that variations in the diameters of soft rolls are very small because the grinding allowances of these rolls are small. This reduced total height variation has enabled the complete omission of lifting spindles and the slides associated with conventional sets of rolls in a supercalender, and it has been possible to replace this construction with a so-called a pivotal set of rolls, where the intermediate rolls of the set of rolls are mounted on the frame of the calender by means of articulated arms pivotally mounted to the frame. This arrangement is possible since variations of the total height of the set of rolls are small, the vertical distance of movement required by an individual roll is small, and because of this, irrespective of the articulated attachment of the rolls, the movements of the rolls relative to the nip level are very small when adjusting the height position of the roll.

Articulated sets of rolls of the type discussed are disclosed, in U.S. Pat. No. 5,438,920, U.S. Pat. No. 5,806,415, and the international application whose publication number is WO 98/50628. The entire disclosures of these three publications are incorporated herein by reference.

The modernization of a calender having spindles to move the rolls in the direction of the stack to a multi-nip calender having pivotal arms for holding the rolls involves a lot of work, because many operations have to be performed on existing constructions, such as the calender frame.

OBJECTS AND SUMMARY OF THE INVENTION

Accordingly, it is an object of the present invention to provide a calender which meets the demands of modem calender constructions and up-to-date multi-nip calenders by using existing calender constructions in a simple manner.

It is another object of the invention to provide a method for rebuilding an existing calender into a modernized multi-nip calender.

With a view to attaining the objects of the invention set forth above, the intermediate rolls are attached to arms pivotable on auxiliary frames, which in turn are attached to vertical portions of the supporting frame of the old calender. With the help of auxiliary frames, all the necessary equipment for modernization can be incorporated in the frame of the old calender, and the vertical portions of the old frame that is, the vertical posts designed to carry the vertical spindles and shaped to act as guides for the bearing housings of the rolls need only be changed in view of the mounting the auxiliary frames.

The auxiliary frames can be designed as profiles which in part clamp around the old guides of the frame, and, being composed of several parts wrap around the existing vertical portions of the old calender frame. The arms supporting the intermediate roll at both ends thereof can each be pivoted to this profile to both lateral portions thereof on opposite sides of the vertical portion of the old frame. The arms can also provide a place for mounting revolvingly the inner fly rolls that have existed inside the old calender frame.

BRIEF DESCRIPTION OF THE DRAWINGS

Additional objects of the invention will be apparent from the following description of the preferred embodiment thereof taken in conjunction with the accompanying non-limiting drawings, in which.

DETAILED DESCRIPTION OF THE PREFERRED EMBODIMENTS

Figure 1:
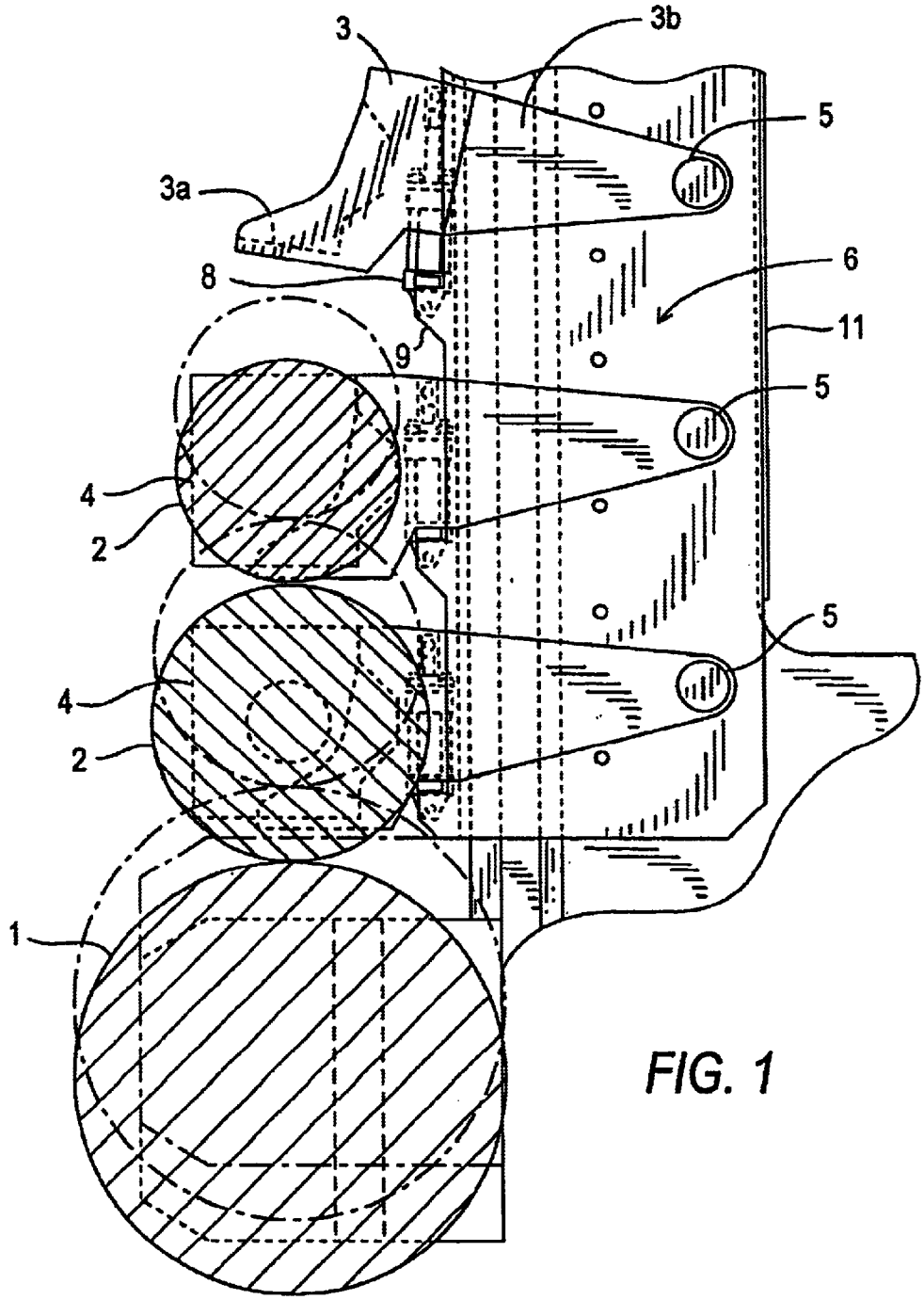
FIG. 1 is a side view of a portion of the calender roll stack in a modernized calender.

FIG. 1 shows the lower part of a calender stack showing the bottom roll 1 and two lowermost intermediate rolls 2.

The intermediate rolls 2 are attached at their both ends revolvingly to arms 3, that is, each intermediate roll 2 is supported by a pair of arms 3, to which the respective bearing housings 4 of the rolls are fixed. The arms 3 are pivoted at 5 to an auxiliary frame 6, which extends vertically in the direction of the vertical portion 7 of the old frame. The auxiliary frames 6 wrap around the respective vertical frame portions 7 that exist in the old calender at both edges of the vertical calender stack. The attachment to the old frame will be described hereinafter in more detail.

Further, at each end of an intermediate roll 2, there is an actuator 8 disposed between a forwardly protruding bracket 9 of the auxiliary frame 6 and the arm 3 to provide movements of the roll 2 and to provide relief force, when necessary during the calendering, and they are used to control the load in the calendering nips. The actuators 8, which are preferably hydraulic cylinders, can act on the same principle as disclosed in the aforementioned U.S. Pat. Nos. 5,438,920 and 5,806,415 and international application WO 98/50628.

FIG. 1 also shows a shelf 3*a* in each arm 3 forming a support surface under the bearing housing to make the roll change easier and safer. These support surfaces can act as a temporary support for a roll when it is fastened to the arms by its bearing housing.

Figure 2:
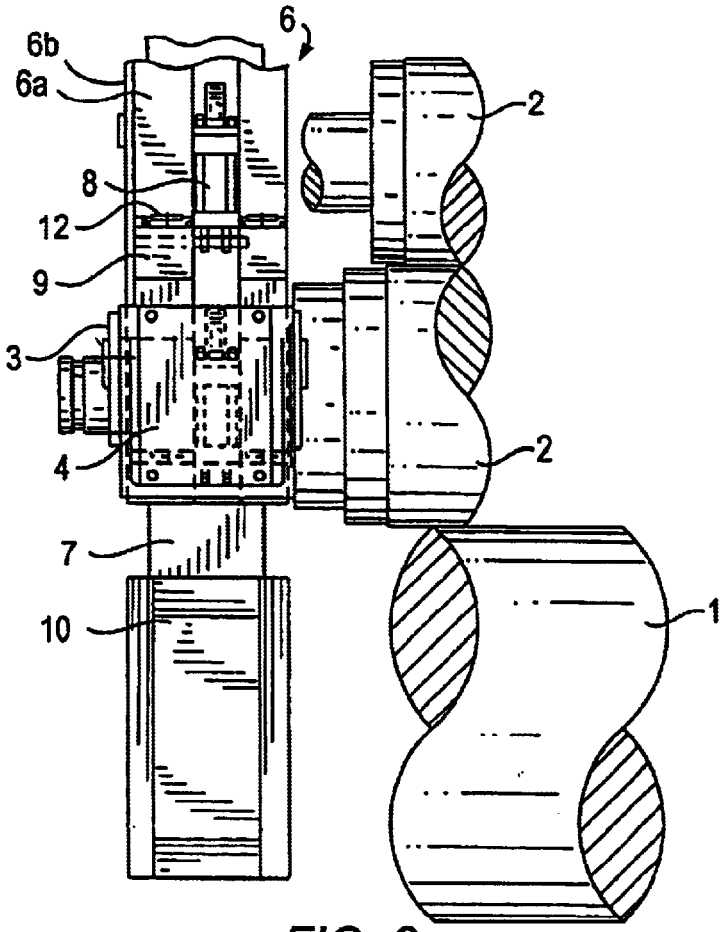
FIG. 2 is a front view of the same.

FIG. 2 shows one of the vertical portions of the calender frame at one edge of the stack of rolls in front view, it being understood that the construction is identical in a mirror-symmetrical manner at the opposite edge of the stack. The revolving attachment of the lowest intermediate roll 2 to the bearing housing 4 is shown entirely, whereas the ends of the bottom roll 1 and the second lowest intermediate roll 2 as well as the arm 3 carrying the second lowest intermediate roll have been omitted for showing the spacer piece 10 attached at the front side of the vertical portion 7 of the old frame at the height of the bottom roll 1 and the position of the actuator 8 at the front side of the auxiliary frame 6. As shown in FIG. 2, the auxiliary frame does not extend to the height of the bottom roll 1, but ends a short distance above the spacer piece 10 to be described in more detail hereinafter.

Figure 3:
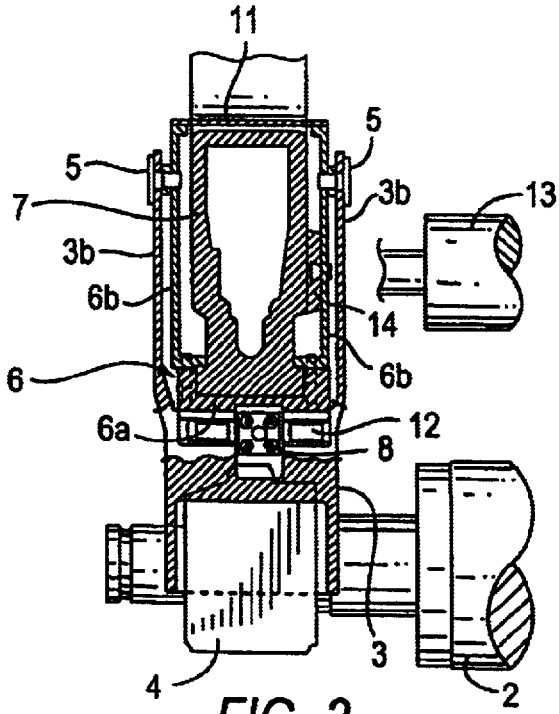
FIG. 3 is a horizontal cross-section of one of the vertical portions of the frame of a modernized calender.

FIG. 3 shows the structure of the vertical portion 7 of the old frame and the auxiliary frame 6 as well as their connection to each other in horizontal cross-section. The auxiliary frame 6 is made of steel and wraps around the vertical portion 7 of the old frame by surrounding it in the form of a U-shaped assembled profile and a back plate 11 attached to the U-shaped profile. The U-shaped profile of the auxiliary frame 6 has a base portion 6*a* lying against the front side of the vertical portion 7 of the old frame, and two portions 6*b* extending therefrom to both lateral sides of the vertical portion 7 of the old frame. This U-shaped profile is assembled of three parts which clamp to the vertical guide in the front portion of the vertical post 7. The base part 6*a* has the form of a shallow U to which L-shaped parts 6*b* forming the side portions are bolted so that the guide portion where the bearing housings of the old calender have slided on is clamped between the base part 6*a* and the shorter sides of the L-shaped parts 6*b* which in the area near their free ends rest against the shoulders of the guide construction.

FIG. 3 also shows shock absorbers in the form of cushions or pads 12 being placed on the upper side of the brackets 9 protruding forwardly of the auxiliary frame 6. Each bracket 9 has a pair of these shock absorbers disposed at both sides of the actuator 8 and designed to dampen the shock caused by a quick drop of the arm 3. The arm has two legs 3*b* extending in approximately parallel relationship to the side portions 6*b* of the auxiliary frame 6. Both legs 3*b* are pivoted to respective side portions 6*b* to make the arm 3 pivotable in vertical plane. Finally, the back plate 11 is attached to the free ends of the side portions 6*b* of the auxiliary frame to form a cover plate and to complete the auxiliary frame to a closed structure wrapping or enclosing completely the vertical portion 7 of the old frame. The main purpose of the back plate 11 is to stabilize the side portions 6*b* by connecting the side portion (side plate) 6*b* attached to the old fly roll mount 14 to the other side portion (side plate) 6*b*. The back plate also gives the frame a renewed appearance.

One feature of the invention is the mounting of the inner fly rolls 13 guiding the web between successive nips inside the calender frame, it being understood that the calender also comprises outer fly rolls guiding the web in positions forwardly of the calender frame. The inner fly rolls 13, previously attached to a fixed position revolvingly to the vertical portions 7 of the old frame (their previous mounting point now serving as attachment of the inner one of the auxiliary frame side portions 6*b*, denoted with 14 in FIG. 3), are now, with their shaft shortened correspondingly, mounted revolvingly to the arms 3, at each end to the inner one of the two legs 3*b* of the respective arm 3. The outer fly rolls are mounted in a known manner to the bearing housings 4 of the intermediate rolls 2. It is understood that the mounting of these outer fly rolls is known to anyone skilled in the art and they are not shown. The inner fly rolls do not need readjustment when the intermediate rolls 2 are replaced with rolls of another diameter, because they will be always in a correct position with respect to the adjacent intermediate rolls 2, and they always provide essentially a constant web path length. Tearing or wrinkling of the web is thus avoided. As to the general principle of guiding the web alternately on both sides of the calender stack by means of the fly rolls, reference is made to the U.S. Patents and International Application discussed above.

Figure 4:
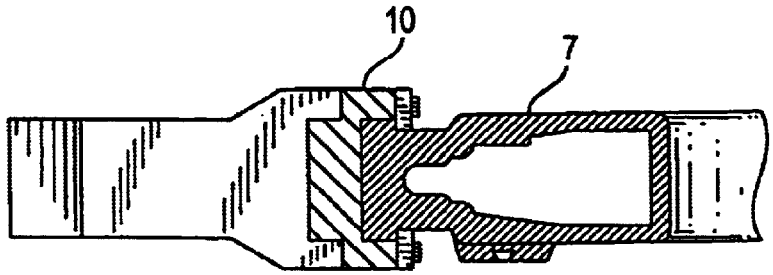
FIG. 4 is a horizontal cross-section of the frame at the height of the bottom roll.

FIG. 4 shows the structure of the calender frame in cross-section taken at the height of the bottom roll 1. As already mentioned hereinabove, the auxiliary frame 6 does not extend to the lowest area of the calender frame but at the height of the shaft of the bottom roll 1, it is replaced by a spacer piece 10 clamping around the front portion of the vertical portion of the old frame much in the same manner as the base part 3*a* of the auxiliary frame to space the old bearing housing of the bottom roll 1 so that the center line of the bottom roll 1 will be aligned with the center lines of the intermediate rolls above it in a common nip plane. However, the connection of this spacer piece to the vertical portion 7 of the old frame is slidable to allow the vertical movement of the bottom roll 1 along the nip plane.

Alternatively, the auxiliary frame 6 can extend to the height of the bottom roll 1, and it can go all the way to the floor. It can act in its lower portion as the guide for the bottom roll. This lower portion of the auxiliary frame can be used in the same way as the spacer piece, that is, to space the bottom roll out to align it with the new centerlines of the intermediate rolls.

One preferred sequence of operations of a rebuild of a calender, without the intention to limit the scope of invention, is as follows:

A. Demolition (removal of fly rolls, stack rolls, spindles, top loading cylinders and auxiliary devices), leaving the supporting frame B. Installation of wrap-around frame (auxiliary frame)

C. Installation of the pivotal arms

D. Reinstallation of the bottom roll and its bearing housings

E. Reinstallation of the intermediate rolls, bearing housings and auxiliary devices to the pivotal arms F. Reinstallation of the top roll with new bearing housings to the wrap-around frame (auxiliary frame).

It is understood that the invention is not limited to the number and type of rolls in the multi-nip calender that has been accomplished by means of the above elements. The top roll has not been studied above, but for example when the calender of the type shown is modernized, the top roll can be supported in a fixed position by attaching its supports to the upper sections of the auxiliary frames. The top loading cylinders used to apply load to the calender stack are at the same time discarded, and the bottom cylinder can be made to apply the load by providing its supports with loading cylinders. After this, the bottom loading cylinder will both load the calender stack and close the calendering nips. All the rolls are lowered when the calender nips open except the top roll which remains in its fixed location. The top and bottom rolls are preferably deflection compensated rolls.

The invention is not restricted to the embodiment described above, but it can be varied within the scope provided by the appended claims. The invention can be applied to rebuild various types of existing supercalenders, especially to change spindle-operated supercalenders to supercalenders where the rolls are carried by pivotal arms. The invention is not limited to the type and number of rolls either, it being understood that variations to roll structures and number of rolls could be made in connection with the rebuild. It is not necessary to change the intermediate rolls during the rebuild, and the change of these rolls can be decided case by case. The invention is applicable to both off-line and on-line calenders having the typical multiroll construction as shown in this disclosure. Finally, the invention is not restricted to one particular loading principle, it being, however, preferred that the loading take place according to the principles known in the above-mentioned prior art, where upward load on the arms by the actuators provides more load on the top nips according to the principle known in the U.S. Pat. No. 5,438,920 where the nip load produced by the masses of the intermediate rolls and their auxiliary equipment is substantially relieved. The various intermediate rolls can also have different loads applied to them by the actuators to compensate for unequal rigidity or deflection of the rolls for example according to the principle known from the International Application WO 98/50628, where individual physical properties of the intermediate rolls are taken into account in the regulation of the linear loads in the calendering nips.

Although in the preceding disclosure there has been shown a calender having the frame disposed strictly vertically at an angle of 90° to the horizontal plane, the present invention can be applied also to calenders where the frame and consequently the nip plane of the rolls is inclined at an angle to the horizontal, thus deviating from 90°. The term "vertical" used throughout the description and claims shall therefore be understood as describing any structure extending from a lower level to an upper level, either straight up or in an inclined fashion.

I claim:

1. A method of rebuilding a calender including a supporting frame and a set of rolls journaled on bearing housings attached to vertical portions of the supporting frame so as to form a stack of rolls in which adjacent rolls placed one above another form calendering nips therebetween, the stack including a top roll, a bottom roll, and a plurality of intermediate rolls between the top roll and the bottom roll, the supporting frame further carrying spindles to move the rolls; said method comprising the steps of:

detaching at least some of said intermediate rolls by removing their bearing housings from said supporting frame;

removing the spindles from said supporting frame;

providing a plurality of pivotal arms configured to receive bearing housings;

providing a pair of auxiliary frames configured to be attached to the supporting frame and to support the plurality of arms;

attaching the auxiliary frames to vertical portions of said supporting frame to extend vertically in the direction of the vertical portions;

mounting the pivotal arms to said auxiliary frames one above another to permit the pivotal movement thereof with respect to said auxiliary frames;

providing a plurality of force relieving actuators;

coupling the force relieving actuators to said pivotal arms; and mounting intermediate rolls by their bearing housings on said pivotal arms.

2. The method according to claim 1, further comprising detaching said bottom roll and its support from said supporting frame and then attaching on a spacer piece to the support of the bottom roll and attaching said spacer piece slidably on a guide on the supporting frame.

3. The method as claimed in claim 1, further comprising arranging said force relieving actuators between the auxiliary frame and the pivotal arms carrying the intermediate rolls.

4. The method as claimed in claim 1, further comprising mounting each of said auxiliary frames around the vertical portion of the frame to totally enclose said vertical portion.

* * * * *